United States Patent [19]

Kamohara et al.

[11] Patent Number: 4,562,377

[45] Date of Patent: Dec. 31, 1985

[54] INSULATED SHADOW MASK ASSEMBLY FOR A PICTURE TUBE

[75] Inventors: Eiji Kamohara; Kazuyuki Seino, both of Fukaya, Japan

[73] Assignee: Tokyo Shibaura Denki Kabushiki Kaisha, Kawasaki, Japan

[21] Appl. No.: 547,355

[22] Filed: Oct. 31, 1983

[30] Foreign Application Priority Data

Nov. 1, 1982 [JP] Japan ..... 57-190791

[51] Int. Cl.[4] ..... H01J 29/07

[52] U.S. Cl. ..... 313/402; 313/407; 445/47

[58] Field of Search ..... 313/402, 407; 445/47

[56] References Cited

U.S. PATENT DOCUMENTS 4,112,563 9/1978 Van Esdonk ..... 29/25.14

4,392,914 7/1983 Takenaka et al. ..... 313/402 X

*Primary Examiner*—David K. Moore

*Assistant Examiner*—K. Wieder

*Attorney, Agent, or Firm*—Cushman, Darby and Cushman

[57] ABSTRACT

A color picture tube provided with a plurality of shadow masks, each of which is formed of a main part having a curved surface with a large number of apertures and a skirt section supporting the peripheral portion of said main part, and the curved surfaces of said plural shadow masks are spaced from each other at a prescribed distance. The parts extending substantially perpendicularly to the curved surfaces of the skirt sections of at least two of the plural shadow masks is comprised of alternately arranged support portions and intervening cutouts. The support portions of the skirt section of one shadow mask face the corresponding alternate cutouts of the skirt section of the other shadow mask and the cutouts of the skirt section of said one shadow mask face the support portions of the skirt section of the other shadow mask so as not to overlap each other.

5 Claims, 11 Drawing Figures

INSULATED SHADOW MASK ASSEMBLY FOR A PICTURE TUBE

BACKGROUND OF THE INVENTION

This invention relates to a color picture tube which is constructed by disposing close to a phosphor screen a plurality of spaced shadow masks provided with a large number of apertures allowing for the passage of electron beams, and more particularly to a shadow mask assembly.

One of color picture tubes provided with a plurality of shadow masks known to date is a mask focusing type. Electron beams are very efficiently utilized in such mask focusing type color picture tube, in which a plurality of spaced shadow masks are respectively provided with prescribed different potentials; and an electron lens for focusing electron beams passing through the apertures of the shadow masks is formed between the shadow masks. Such mask focusing type color picture tube is already set forth in, for example, the U.S. Pat. Nos. 2,971,117 and 3,398,309, Japanese patent publication 38-22,030 and Japanese utility model publication 47-20,451.

Other examples of a color picture tube provided with two parallel shadow masks are also disclosed in the Japanese patent publication 55-2698, Japanese patent application disclosure 50-57575 and Japanese utility model application disclosure 48-93,769. The ordinary color picture tube provided with a single shadow mask has the drawbacks that the impingement of electron beams on the shadow mask results in its thermal deformation, preventing electron beams from being irradiated on the prescribed phosphor regions on a phosphor screen, that is, giving rise to the so-called "mislanding" and consequently a decline in color purity. To avoid such drawbacks, the color picture tubes proposed in the aforementioned publication are characterized in that two parallel shadow masks are provided, thereby shutting off electron beams not required to impinge on the phosphor screen in order to suppress as much as possible the temperature rise of the second mask which plays an important role in prescribing the color purity.

With the above-mentioned focusing type color picture tube and color picture tube particularly designed to prevent the so-called mislanding, the apertures formed in one of the two shadow masks should occupy the corresponding positions to those of the other shadow mask. However, considerable difficulties are encountered in manufacturing such shadow mask assembly. According to the process of producing a mask assembly which is disclosed in, for example, the Japanese patent publications 47-8261 and 47-28,188, an insulating material such as glass is filled between the two shadow masks except for the apertures in order to effect insulation between said two shadow masks, presenting difficulties in manufacturing a mask assembly by press molding. Further, the insulating material tends to be charged by the impingement of electron beams thereon, thus harmfully affecting electron beams passing through the apertures. Therefore, any of the proposed shadow mask assembly-manufacturing methods fails to be put to practical application.

In contrast, the Japanese patent application disclosure 57-138,746 sets forth a practicable shadow mask assembly-manufacturing method which comprises the steps of superposing a plurality of flat metal plates and press-molding them together without interposing an insulating material therebetween, thus assuring the accurate alignment of the mutually facing apertures of the superposed flat metal plates. However, the shadow mask assembly-manufacturing method set forth in the Japanese patent disclosure 57-138,746 has the drawback that when the peripheral or so-called skirt sections of the assembled shadow masks are bent by press work, said skirt sections tend to touch each other, even though the mutually facing planes of the greater part of the assembled shadow masks are spaced from each other at a prescribed distance during fitting to the color picture tube, making it impossible to impress different potentials on the respective shadow masks. Further even when it is designed to impress the same potential on the two shadow masks, the immediate conduction of heat from the first shadow mask to the second shadow mask makes it impossible to suppress the temperature rise of said shadow mask, namely, its resultant thermal deformation. For resolution of the above-mentioned difficulty, it may be contemplated to interpose an insulating material between the skirt sections of the assembled shadow masks. When, however, a shadow mask assembly is constructed by superposing a plurality of flat metal plates by press forming, there is no room between the skirt sections of the superposed shadow masks to allow for the insertion of an insulating material. If it is tried to provide a space of the insertion of an insulating material between said skirt sections, it is necessary to reduce the thickness of the skirt sections of the shadow masks. However, this process objectionably decreases the mechanical strength of the shadow masks. Moreover, the shadow mask metal and insulating material have different degree of ductility. Therefore, extreme difficulties arise in effecting the press molding of two superposed shadow masks with an insulating material interposed therebetween. Further when the color picture tube is heated at 400 to 500° C. during the manufacture of the color picture tube with an insulating material interposed between the shadow masks, then various difficulties arise due to the different physical properties, for example, thermal expansion coefficients of the shadow mask metal sheets and the intervening insulating material, and also due to the different chemical properties, for example, releasabilities of the impurity gases contained in the shadow mask metal sheets and the intervening insulating material. Therefore, the last mentioned known color picture tube-manufacturing method fails to be put to practical application.

SUMMARY OF THE INVENTION

It is accordingly the object of this invention to provide a color picture tube fitted with a shadow mask assembly which can be formed without inserting an insulating material between the shadow masks, said shadow masks being isolated from each other.

To attain the above-mentioned object, this invention provides a color picture tube having a plurality of shadow masks whose curved surfaces are spaced from each other at a prescribed distance, and each of which is formed of a main part having the curved surface bearing a large number of apertures and a skirt section which supports the peripheral portion of said main part. Referring to two adjacent shadow masks included in a plurality thereof, the skirt section of each shadow mask set substantially perpendicular to its curved surface comprises alternate support portions and corresponding adjacent cutouts. To prevent the skirt section of one shadow mask substantially perpendicular to its curved surface from overlapping that of the other shadow mask, the alternate support portions of the skirt section of one shadow mask face the corresponding alternate cutouts of the skirt section of the other shadow mask, and the cutouts of the skirt section of said one shadow mask face the corresponding alternate supporting portions of the skirt section of said other shadow mask.

This invention provides an inexpensive color picture tube in which a plurality of shadow masks remain insulated from each other even when flat shadow masks are superposed on each other and press-molded without interposing an insulating material between said shadow masks, thereby enabling the respective shadow masks to be impressed with different potentials.

A color picture tube embodying this invention has the advantages that an insulating material need not be interposed between a plurality of flat masks, and it is possible to suppress the occurrence of various difficulties, which, if an insulating material is used, might arise during the subsequent manufacturing steps due to differences between the physical and chemical properties of the shadow mask metal and insulating material.

DETAILED DESCRIPTION OF THE PREFERRED EMBODIMENTS

Figure 1:
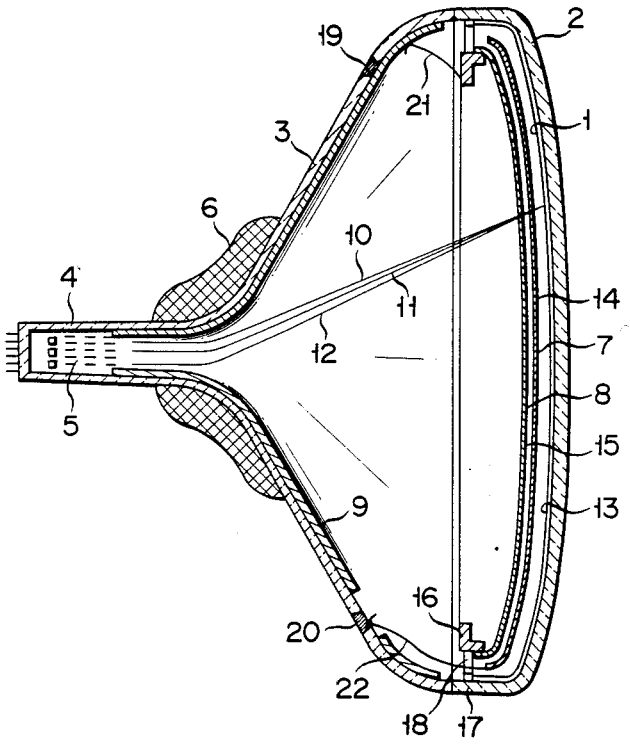
FIG. 1 is a cross sectional view of a color picture tube comprising a shadow mask assembly embodying this invention.

Description will now be given with reference to the accompanying drawings of a shadow mask assembly embodying this invention used with a color picture tube. FIG. 1 illustrates a color picture tube provided with a shadow mask assembly embodying this invention, showing a schematic arrangement of a mask focusing type color picture tube. The mask focusing type color picture tube of FIG. 1 mainly comprises:

- a face plate 2 having a phosphor screen 1;
- a neck 4 connected to the peripheral edge of the face plate 2 by means of a funnel 3;
- an electron gun 5 received in the neck 4;
- an electron beam-deflecting device 6 fitted to that portion of the outer wall of the color picture tube which extends from the funnel 3 to the neck 4;
- a shadow mask assembly consisting of a shadow mask 7 bearing a large number of apertures 14 which spatially faces to the screen 1 and another shadow mask 8 having a large number of apertures 15 which spatially faces the shadow mask 7 at the side of electron gun 5;
- a conductive layer 9 uniformly deposited from the inner wall of the funnel 3 to part of the neck 4.

A plurality of metal-backed phosphor elements 13 displaying three colors are regularly arranged on the screen 1. A pin 17 is fitted to the inside of the peripheral edge portion of the face plate 2 to support a frame 16. This frame 16 is securely set in place by the engagement of the pin 17 with an elastic member 18 welded to the frame 16. The shadow mask 8 is welded to the frame 16. The other shadow mask 7 is supported on said shadow mask 8 by means of a fixing element.

Two buttons 19, 20 are embedded in the funnel 3. One button 19 is connected to the conductive layer 9, and another button 20 is insulated from said conductive layer 9, thereby assuring the external impression of different potentials.

The shadow mask 8 facing the electron gun 5 is connected to the conductive layer 9 deposited on the funnel 3 by means of the frame 16 and connector 21, and also to the screen 1 by means of the frame 16 and pin 17. The shadow mask 8 is impressed with high anode voltage. The shadow mask 7 facing the screen 1 is connected by a connector 22 to a button 20 insulated from the conductive layer 9 and externally impressed with a voltage slightly lower than the aforesaid high anode voltage.

With the above-mentioned arrangement of the color picture tube of this invention, three electron beams 10, 11, 12 issued from the electron gun 5 are deflected by a deflecting device 6. The electron beams 10, 11, 12 pass through the apertures 15 of the first shadow mask 8 and an conducted through the apertures 14 of the second shadow mask 7 while undergoing a lens effect, and, when reaching the surface of the screen 1, impinge on the corresponding phosphor elements to let them emit lights. Therefore, the apertures 14 of the second shadow mask 7 and the apertures 15 of the first shadow mask 8 must exactly be aligned with each other. The above-mentioned shadow mask assembly is manufactured through the following steps.

Figure 2:
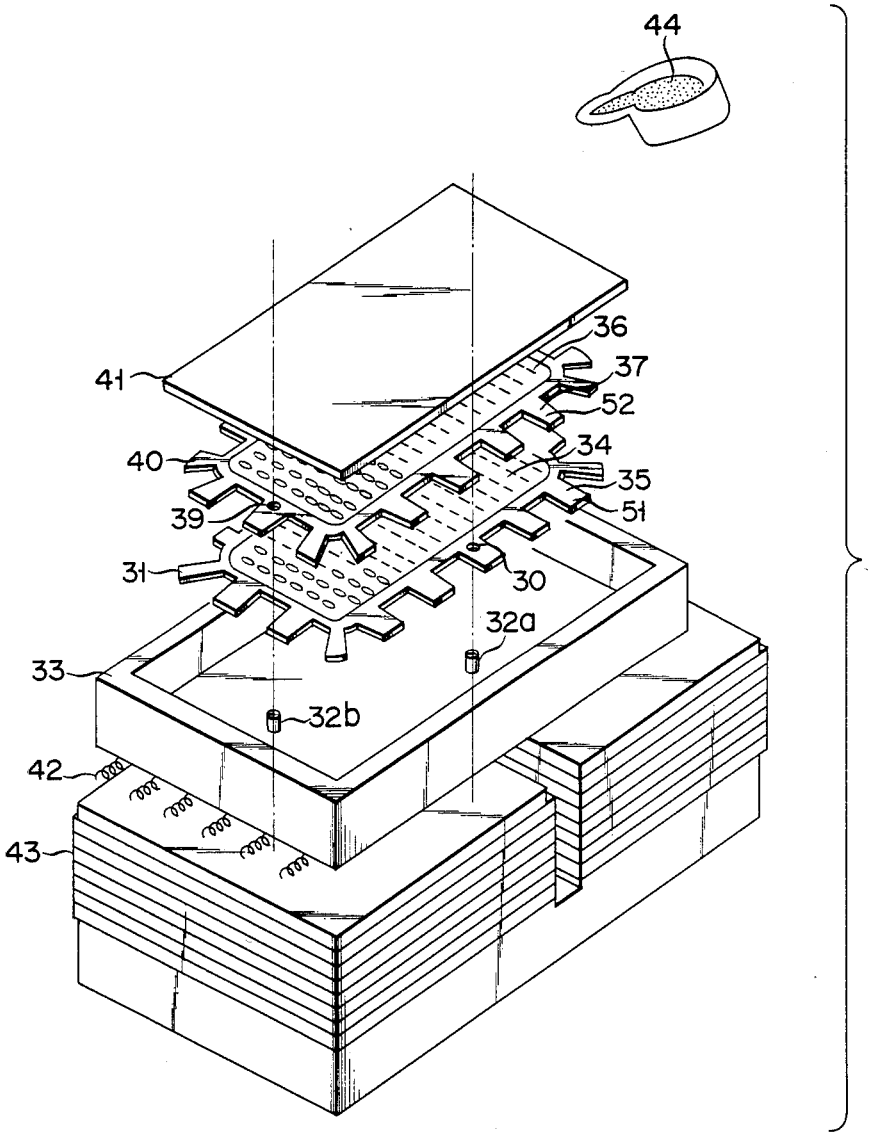
FIG. 2 is an oblique view showing the manner in which a shadow mask assembly embodying the invention is constructed.
Figure 3:
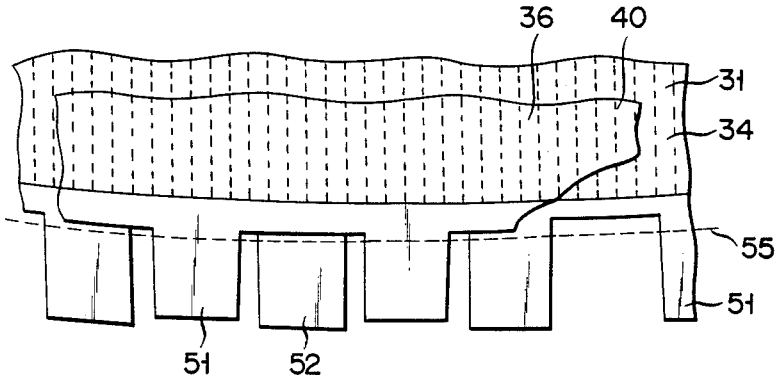
FIG. 3 is a fractional plan view of the main part of the flat masks indicated in FIG. 3.

As shown in FIG. 2, a first flat shadow mask 31 having a reference hole 30 is mounted on a box-shaped platen 33 provided with reference pins 32*a*, 32*b* with said reference pin 32*a* aligned with the reference hole 30. Similarly, a second flat mask 40 bearing a reference hole 39 is set on the first flat mask 31, with the reference pin 32*b* aligned with the reference hole 39. Last, an upper plate 41 is placed on the assembly of the first and second flat masks 31, 40. The first and second flat shadow masks 31, 40 respectively comprise effective sections having apertures 34, 36, and noneffective sections 35, 37 free from apertures. The noneffective sections 35, 37 are formed in the pectination. However, as shown in FIG. 3, the alternate teeth of the pectination 51 of the noneffective section 35 of the first flat shadow mask 31 face the alternate cutouts of the pectination 52 of the noneffective section 37 of the second flat shadow mask 40, thereby preventing both pectinations 51, 52 from exactly overlapping each other. A dotted line 55 given in FIG. 3 represents a direction in which the pectinations 51, 52 of the first and second shadow masks 31, 40 are bent by press work in the subsequent step.

The bent pectinations 51, 52 constitute the skirt sections of the respective shadow masks.

The first and second flat shadow masks 31, 40 are fabricated for example, with the following specification. The whole of the first flat shadow mask 31 has a size of about 332×432 mm. With the pectination section of the first flat shadow mask 31, the tooth 51 has a width of about 20 mm, and a length of about 16 mm. A pitch between two adjacent teeth 51 measures about 50 mm. The whole of the second flat shadow mask 40 has a size of about 330×430 mm. With the pectination section of the second flat shadow mask 40, the tooth 52 has a width of about 20 mm and a length of about 17 mm. A pitch between two adjacent teeth 52 measures about 50 mm. The teeth 51 and 52 are respectively spaced from each other at a distance of about 5 mm substantially in the interdigitated relationship as viewed in the direction in which the first and second flat shadow masks 31, 40 are set one above the other. Therefore no portions of the teeth 51 and 52 of the first and second shadow masks 31, 40 overlap each other. The first and second flat shadow masks 31, 40 and upper plate 41 are prepared from iron, and the box-shaped plate 33 is formed of nonmagnetic material. Referring to FIG. 2, a heater 42 is provided below said platen 33, and an electromagnet 43 is set below said heater 42. After the first and second flat shadow masks 31, 40 and upper plate 41 are placed on the platen 33, the electromagnet 43 is actuated to tightly press said three iron plates together. The heater 42 is operated to heat the platen 33 and three iron plates 31, 40, 41. Thereafter, molten paraffin 44 (separately shown in FIG. 2) is poured into the apertures of the first and second flat shadow masks 31, 40. Thereafter, the heater 42 is stopped to solidify the paraffin 44 poured into the shadow mask apertures by cooling. After the electromagnet 43 is deactivated, the first and second flat shadow masks 31, 40 fixed together by the paraffin 44 are removed from the platen 33. At this time, the first and second flat shadow masks 31, 40 are tightly fixed together by the paraffin 44 all over, with the apertures of both shadow masks 31, 40 exactly aligned with each other.

Figure 4:
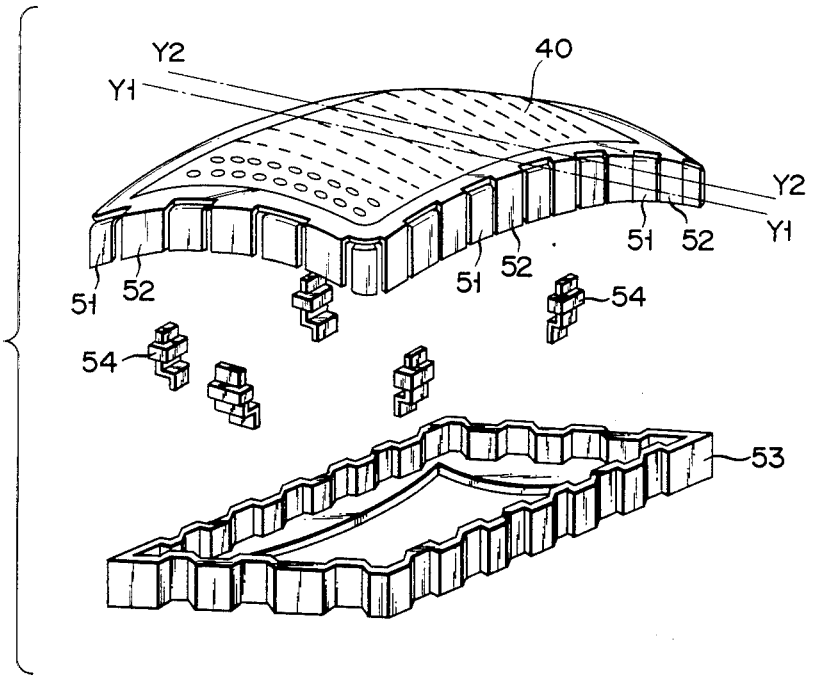
FIG. 4 is an oblique view showing the arrangement of a shadow mask assembly according to a first embodiment of this invention.
Figure 5A:
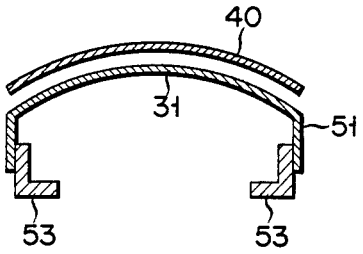
FIGS. 5A and 5B are respectively the cross sectional views of a shadow mask assembly on $Y_1$—$Y_1$ line and $Y_2$—$Y_2$ line of FIG. 4.
Figure 5B:
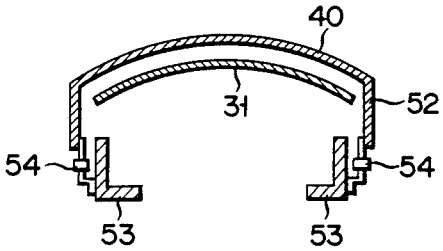

The first and second shadow masks 31, 40 are fabricated together by press work into a shaped article (FIG. 4) which comprises a curved surface formed with a prescribed curvature and folded skirt sections 51, 52. Thereafter, the paraffin 44 is thermally dissolved or removed by chemical dissolution by applying, for example, trichloroethylene. The skirt section 51 of the first shadow mask 31 is fixed to a frame 53 by welding. Both ends of a plurality of fixing elements 54 are welded to the skirt section 52 of the second shadow mask 40 and the frame 53 respectively, to securely fix said skirt section 52 and frame 53 together. In this case, the curved surface of the second shadow mask 40 is spaced from that of the first shadow mask 31. The fixing element 54 is constructed by embedding a metal chip in both end faces of a glass member. The metal chips are insulated from each other by the intervening glass member. As seen from FIG. 4, the peripheral wall of the frame 53 is fabricated in the form of alternately arranged convex and concave parts in the interdigitated relationship to the zigzag outline of the skirt section 52 of the second shadow mask 40, but with a sufficient clearance allowed between the peripheral wall of the frame 53 and the skirt section 52 of the second shadow mask 40. The skirt section 51 of the first shadow mask 31 contacts the convex parts of the peripheral wall of the frame 53, whereas the skirt section 52 of the second shadow mask 40 does not touch the concave part of the peripheral wall of the frame 53. FIGS. 5A and 5B are the sectional views of a shadow mask assembly constructed as described above on lines $Y_1$–$Y_1$ and $Y_2$–$Y_2$ of FIG. 4.

No insulating material is interposed between the curved surfaces of the first and second shadow masks included in the aforementioned shadow mask assembly embodying this invention. A fixing element 54 containing an insulating material is fitted to the skirt section 52 of the second shadow mask 40 after both shadow masks are fabricated by press forming. Therefore, no insulating material is present between the first and second shadow masks before press forming, thereby assuring an easy and inexpensive press forming.

The foregoing embodiment refers to the case where the shadow mask assembly comprised two shadow masks. However, this invention is not limited to said embodiment, but is applicable to the case where a shadow mask assembly consists of three or more shadow masks. For example, where a shadow mask assembly is formed of three shadow masks, it is advised to sufficiently broaden a distance between every adjacent teeth of the pectination-shaped skirt sections of the first, second and third shadow masks in order to prevent the respective teeth of said pectination-shaped skirt sections from overlapping each other, directly weld to the frame the skirt section of that of the three shadow masks which is set nearest to the frame, fix the skirt sections of the second and third shadow mask to the frame by a plurality of fixing elements. This process inables the three shadow masks to be securely fixed to the frame with insulation maintained therebetween.

A second process of assembling three shadow masks comprises the steps of shaping the skirt sections of the first and third shadow masks into the pectination forms whose teeth overlap each other; shaping the skirt section of the intervening second shadow mask into the pectination form whose teeth do not overlap those of the pectination forms of the skirt sections of the first and third shadow masks; directly welding to the frame the skirt section of the first shadow mask which lies nearest to said frame; welding both ends of a plurality of fixing elements to the skirt section of the second shadow mask and frame respectively; and directly weld the skirt section of the outermost third shadow mask to the frame at the same welding point as that of the skirt section of the first shadow mask. The above-mentioned second process enables three shadow masks to be securely fixed with the intervening second shadow mask insulated from the outer first and third shadow masks.

With the foregoing embodiment, the teeth of the pectination shapes of the skirt sections of the shadow masks were chosen to have substantially the same size and shape and be spaced from each other at approximately the same pitch. However, this invention is not limited to such arrangement. But the respective teeth may have any size and shape and be arranged at any pitch, provided that they do not occupy the mutually overlapping positions.

Figure 6:
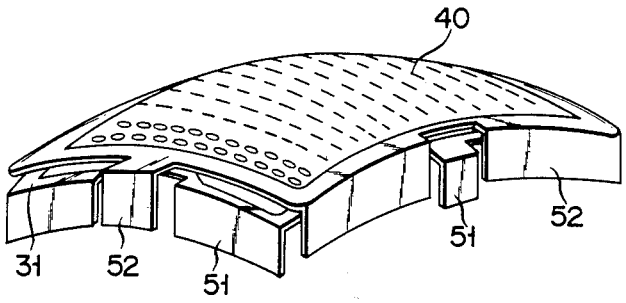
FIG. 6 is an oblique view of a shadow mask assembly according to a second embodiment of the invention.

With the present invention, the skirt section of each shadow mask need not be formed into the pectination shape. The point is that the skirt section of one shadow mask be prevented from overlapping that of another shadow mask. Namely as shown in FIG. 6, one cutout between two wide teeth of the skirt section of one shadow mask faces one narrow tooth of the skirt section of another adjacent shadow mask.

Figure 7:
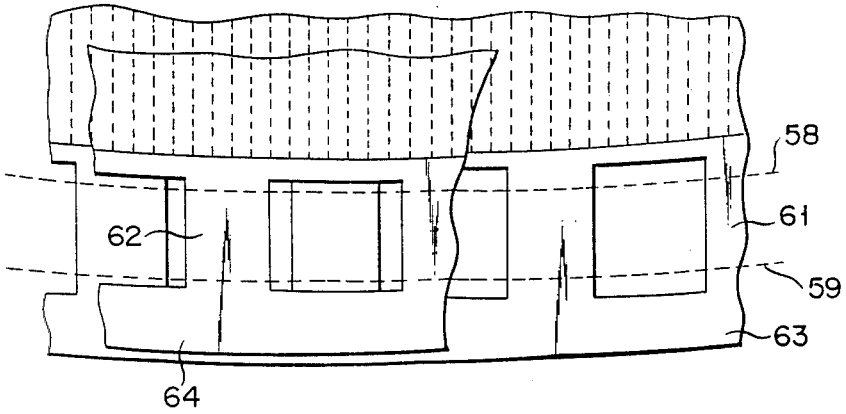
FIG. 7 is a fractional sectional view of the main part of flat shadow masks involved in a shadow mask assembly according to a third embodiment of the invention.
Figure 8:
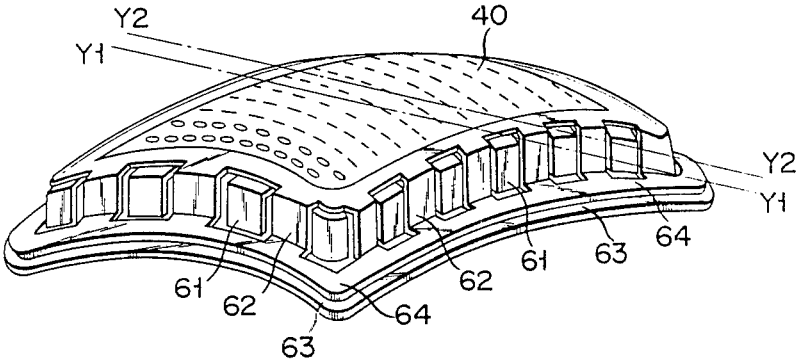
FIG. 8 is an oblique view of a shadow mask assembly produced from the flat shadow masks of FIG. 7.
Figure 9A:
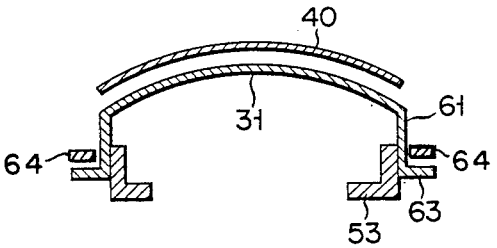
FIGS. 9A and 9B are respectively the cross sectional views of a shadow mask assembly on $Y_1$—$Y_1$ line and $Y_2$—$Y_2$ line of FIG. 8.
Figure 9B:
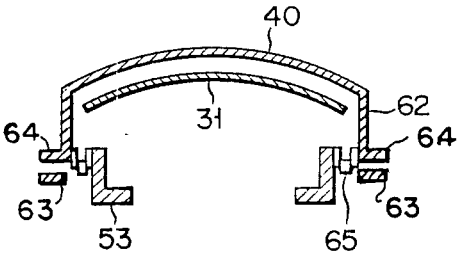

With the foregoing embodiment, the skirt sections of two adjacent shadow masks do not overlap each other at any point. However, this invention is not limited to such arrangement. If non-contact is assured between two adjacent shadow masks, the skirt sections of the respective shadow masks may partly overlap each other by the press forming. For instance, when, as shown in FIGS. 7 and 8, the skirt sections of two shadow masks are formed of the portions 61, 62 which are folded along the bending line 58 and extend substantially perpendicularly to the curved surfaces of the shadow masks and the portions 63, 64 which are folded along the bending line 59 and extend in substantially parallel with the curved surface of the shadow masks, then the extending portions 63, 64 may overlap each other, provided the extending portions 61, 62 do not overlap each other. The following is the reason. Like the curved surfaces of the shadow masks, the extending portions 63, 64 can be spaced from each other at a prescribed distance even when they overlap each other. In this case, the second mask 40 is securely fixed to the frame with an insulated condition maintained by fixing element like the U-shaped and the first mask 31 is securely fixed to the frame directly by welding. The shadow masks whose skirt sections are constructed with the aforementioned outline can be elevated in mechanical strength and also have an excellent working ability. FIGS. 9A and 9B are respectively the cross sectional views of the shadow masks having a curved surface on lines $Y_1$–$Y_1$ and $Y_2$–$Y_2$ of FIG. 8.

In the foregoing embodiment, two flat metal shadow masks were closely pressed against each other by means of an electromagnet and securely fixed in place by paraffin. However, the shadow masks can be securely fixed in place not only by the above-mentioned process but also by many other methods. The methods set forth in the Japanese patent disclosure Nos. 57-138,746, 58-44,645 and 58-44,646 may be cited as instances.

In the aforementioned embodiment, two flat shadow masks were first closely pressed against each other by an electromagnet and finally fabricated into a shadow mask assembly by press forming. As set forth in the Japanese patent disclosure No. 58-97,243, however, it is possible to fabricate a shadow mask assembly, for example, by press forming, with two flat metal shadow masks previously spaced from each other at a prescribed distance.

As previously mentioned, this invention can provide an inexpensive color picture tube provided with a shadow mask assembly having such a construction as allows insulating a plurality of shadow masks from each other and the impression of different potentials on them even when they are assembled by superposing a plurality of flat shadow masks and press-forming them without filling any insulating material in a space defined between them.

Further as previously described, a color picture tube embodying this invention dispenses with the filling of an insulating material in a space defined between the adjacent flat masks in a press-forming step, thereby suppressing the occurrence of difficulties which might otherwise arise during the subsequent manufacturing steps due to differences between the physical and chemical properties of the shadow mask metal plate and those of the insulating material.

What is claimed is:

1. A shadow mask assembly for a color picture tube, comprising:

a plurality of shadow masks, each mask having a curved surface with a plurality of apertures therein and a skirt section supporting the peripheral portion of said a curved surface, said curved surfaces being spaced from each other at a predetermined distance, wherein skirt sections of at least two of said plural shadow masks extend substantially perpendicularly to said curved surfaces and define alternately arranged support portions and cutouts, with support portions of one skirt section facing corresponding alternate cutouts of the other skirt section and cutouts of said one skirt section facing support portions of said other skirt section to prevent overlapping of said support portions extending substantially perpendicularly to said curved surfaces and thereby electrically insulate said plurality of shadow masks from each other.

2. An assembly according to claim 1, wherein said skirt sections of said at least two shadow masks each comprises a pectination-shaped plate having a folded portion substantially perpendicularly to a curved surface of a respective shadow mask, with said support portions being defined by tooths of said pectination-shaped plate and said cutouts being defined by spaces defined by adjacent teeth of said pectination-shaped plates.

3. An assembly according to claim 2, wherein a substantially rectangular shadow mask is defined by two mutually facing sides thereof each comprising two support portions folded substantially perpendicularly to the curved surface of said shadow mask with one cutout intervening between said two support portions, and two other mutually facing sides of said rectangular mask each similarly composed of two cutouts and one support portion, said one support portion being folded substantially perpendicularly to the curved surface of said rectangular shadow mask and intervening between said two cutouts.

4. An assembly according to claim 1, wherein said skirt sections of at least two of said shadow masks each comprises at least two support portions and two cutouts, with said support portions of one shadow mask not overlapping said support portions of the other shadow mask.

5. An assembly according to claim 1, wherein said skirt sections of at least two of said shadow masks each comprises a first portion adjacent to said curved surface of said shadow mask and extending substantially perpendicular to said curved surface and a second portion adjacent to said first portion and extending substantially parallel with said curved surface, with said cutouts being formed in said first portion.

* * * * *